United States Patent [19]

Hibino

[11] 3,980,858

[45] Sept. 14, 1976

[54] EXCITER FOR INDUCTION HEATING APPARATUS

[75] Inventor: Masahiro Hibino, Amagasaki, Japan

[73] Assignee: Mitsubishi Denki Kabushiki Kaisha, Tokyo, Japan

[22] Filed: Aug. 22, 1974

[21] Appl. No.: 499,756

[30] Foreign Application Priority Data

Aug. 22, 1973 Japan ..... 48-94044

[52] U.S. Cl. ..... 219/10.49; 219/10.79

[51] Int. Cl.[2] ..... H05B 5/04

[58] Field of Search ..... 219/10.49, 10.75, 10.77, 219/10.79, 10.41; 336/100; 13/26

[56] References Cited

UNITED STATES PATENTS

| | | | |
|---|---|---|---|
| 2,001,219 | 5/1935 | Shaw | 219/10.49 |
| 3,382,311 | 5/1968 | Rydinger et al. | 219/10.75 |
| 3,530,499 | 9/1970 | Schroeder | 219/10.49 |
| 3,836,744 | 9/1974 | Taketo et al. | 219/10.49 |
| 3,906,181 | 9/1975 | Hibino et al. | 219/10.49 |

FOREIGN PATENTS OR APPLICATIONS

| | | | |
|---|---|---|---|
| 677,405 | 6/1939 | Germany | 219/10.49 |
| 1,157,711 | 7/1969 | United Kingdom | 219/10.49 |

*Primary Examiner*—Bruce A. Reynolds
*Attorney, Agent, or Firm*—Oblon, Fisher, Spivak, McClelland & Maier

[57] ABSTRACT

An exciter for an induction heating apparatus comprises a central magnetic pole and a plurality of peripheral magnetic poles, a yoke for connecting the magnetic poles and excitation windings wound on the magnetic poles, wherein the first excitation circuit is formed by the excitation winding wound on the central magnetic pole and the second excitation circuit is formed by the excitation windings wound on the peripheral magnetic poles and such are excited by an excitation current having a phase difference of between 70° and 110°.

7 Claims, 20 Drawing Figures

EXCITER FOR INDUCTION HEATING APPARATUS

BACKGROUND OF THE INVENTION

1. Field of the Invention

The present invention relates generally to induction heating apparatus and more particularly to an exciter for an induction heating apparatus which may be applied for a heating element, such as a cooking pot. The exciter of this invention is quite effective for application to a commercial frequency excitation system. U.S. patent application Ser. No. 372,610 now U.S. Pat. No. 3,906,181 is another application of applicant's directed to induction heating apparatus.

2. Description of the Prior Art

It is known to use an induction heating apparatus for heating a heated element by applying an alternating magnetic field formed by AC current of 50 – 60 Hz of commercial frequency to a heated element, such as a cooking pot. Such use of induction heating type cooking apparatus is also known.

The exciters in such apparatus for generating the alternating magnetic field therein usually and conventionally comprise two or three disc iron cores having annular grooves therein and two or three ring windings which are coaxially fitted within these grooves. Such conventional exciters have the following disadvantages, namely that it is difficult to obtain high efficiency in theory alone, it is difficult to provide an alternative component of zero of the electromagnetic force applied to the cooking pot, to cause noise, and it is difficult to form the iron core.

Accordingly, an improvement of such exciters has been proposed having four equi-spaced magnetic poles connected to a yoke and windings wound on these magnetic poles, wherein the first excitation circuit is formed by connecting the windings wound on a pair of magnetic poles, which are not adjacent, on a diagonal line and the second excitation circuit is formed by connecting the windings wound on the other pair of magnetic poles and an excitation current having a phase difference of about 90° is applied to the excitation circuits. In accordance with this exciter, the above-mentioned disadvantages of the former exciters having coaxial ring windings can be overcome. However, this exciter has been found to possess such disadvantages as the cooking pot receiving a turning effect and the electromagnetic forces being applied to the cooking pot in a vertical direction not being balanced when the cooking pot is not placed at the center of the exciter, whereby the cooking pot is vibrated.

SUMMARY OF THE INVENTION

It is therefore an object of this invention to provide an exciter which prevents the turning effect and the vibration and movement of a heated element.

Another object of this invention is to provide an exciter which is excited by an AC current having 50 – 60 Hz commercial frequency, thereby generating an alternating magnetic field for an induction heating of a heated element such as a cooking pot.

Still another object of the present invention is to provide an exciter which gives an alternating component of zero of the electromagnetic forces in the vertical direction of the cooking pot as the electromagnetic forces are balanced, whereby the cooking pot is not vibrated and noise is not generated and a turning effect is not applied to the cooking pot.

Yet another object of the invention is to provide an exciter employing sector iron ring yokes as iron core yokes.

The foregoing objects of the present invention have been attained by providing an exciter for an induction heating apparatus which comprises a central magnetic pole, a plurality of peripheral magnetic poles and windings wound on the magnetic poles wherein the first excitation circuit formed by the excitation winding wound on the central magnetic pole and the second excitation circuit formed by the excitation windings wound on the peripheral magnetic poles are excited by an excitation current having a phase difference of 70° – 110°.

BRIEF DESCRIPTION OF THE DRAWINGS

Various other objects, features and attendant advantages of the present invention will be more fully appreciated as the same becomes better understood from the following detailed description when considered in connection with the accompanying drawings, wherein like reference numerals designate like or corresponding parts in the several views and in which.

DESCRIPTION OF THE PREFERRED EMBODIMENTS

Figure 1:
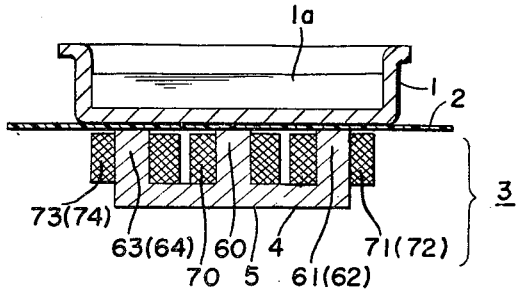
FIG. 1 is a sectional view of one embodiment of an induction heating apparatus according to the present invention.
Figure 2:
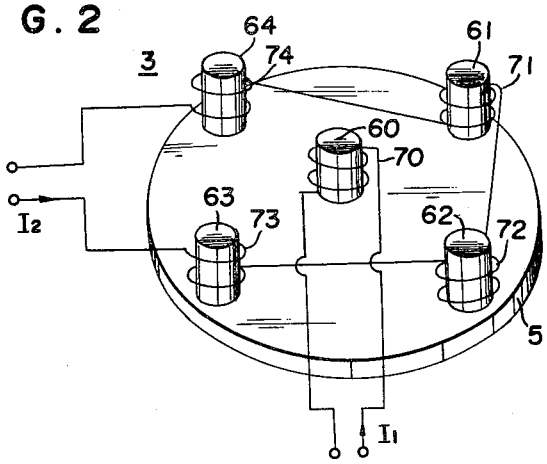
FIG. 2 is a schematic view of one embodiment of an exciter according to the present invention.

Referring now to the drawings and more particularly to FIG. 1 illustrating an induction heating apparatus of this invention and FIG. 2 illustrating an exciter thereof, the reference numeral 1 designates a heating element, such as a cooking pot having water or other contents 1*a* cooking therein. A cover plate 2 on which the heating element 1 is placed has disposed therebelow an exciter 3 having an iron core 4 and a yoke 5. A central magnetic pole 60 is surrounded by peripheral magnetic poles 61, 62, 63 and 64. A winding 70 is wound on the central magnetic pole 60, and windings 71 to 74 are windings wound on the peripheral magnetic poles 61 – 64.

In this embodiment, the windings 71 and 73 are wound on the peripheral magnetic poles 61 and 63 in a left turn, or in a counterclockwise direction, as viewed from above, and the windings 72 and 74 are wound on the peripheral magnetic poles 62 and 64 in a right turn, or clockwise direction. In this structure, the winding 70 wound on the central magnetic pole 60 forms the first excitation, or the central excitation circuit, and the windings 71 – 74 wound on the peripheral magnetic poles 61 – 64 are connected in series or parallel or series-parallel and form the second excitation or peripheral excitation circuit. These two excitation circuits are excited by feeding thereto AC currents $I_1$ and $I_2$ which have a phase difference of about 90° (70° – 110°) from each other.

Figure 3A:
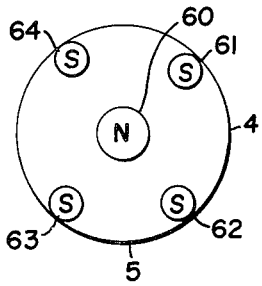
FIGS. 3(*a*) and 3(*b*) are diagrams showing the mutual relationship of the polarity of the magnetic poles in the exciter of FIG. 2.
Figure 3B:
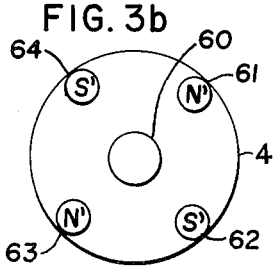

FIG. 3 shows the mutual polarities of the magnetic poles at a certain time, FIG. 3(*a*) showing the magnetic flux polarity pattern formed by only the central excitation circuit, the polarity of the peripheral magnetic poles 61 – 64 being different from that of the central magnetic pole 60. In FIG. 3(*a*), when the central magnetic pole 60 is an N pole, the peripheral magnetic poles 61 – 64 are S poles and the magnetic flux thereof forms a loop between the central magnetic pole and the peripheral magnetic poles.

FIG. 3(*b*) shows the magnetic flux polarity pattern formed by only the peripheral excitation circuit, wherein the polarities of the magnetic poles which are adjacent to each other in the circle formed thereby are different from each other according to the direction of their windings. The magnetic flux forms a loop between the peripheral magnetic poles and does not pass through the central magnetic pole. In the excitation structure, the two excitation circuits are not affected by each other.

When a heated element is placed on the exciter, eddy currents are formed on the heated element by cross alternating magnetic fluxes formed separately by the two excitation circuits and the electromagnetic force components vibrating the heated element are counterbalanced as the phase difference of the two excitation currents is about 90°, whereby no vibration is formed and the noise created is small. Moreover, the exciter of the invention has a characteristic advantage that no turning effect is imparted, which fact is illustrated by referring to the drawing.

Figure 4A:
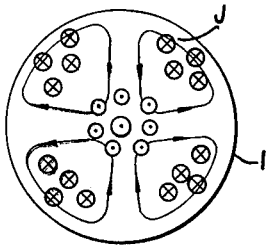
FIGS. 4(*a*) and 4(*b*) are diagrams showing the eddy currents of a cooking pot of the exciter in FIG. 2.
Figure 4B:
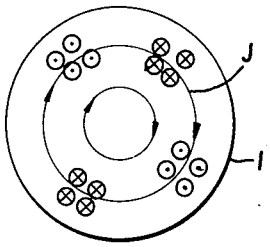
Figure 5A:
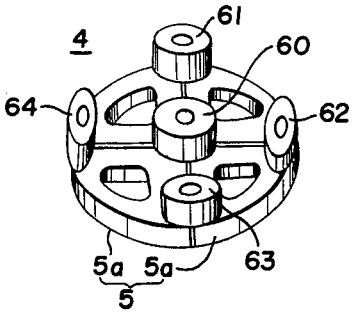
FIG. 5 shows one embodiment of the iron cores of an exciter according to the present invention, wherein FIG. 5(*a*) is a schematic view of the construction, FIG. 5(*b*) is a yoke and FIG. 5(*c*) is a central magnetic pole and FIG. 5(*d*) is a peripheral pole.
Figure 5B:
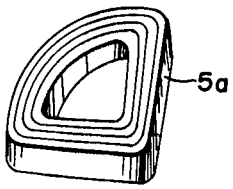
Figure 5C:
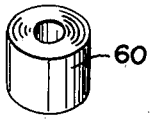
Figure 5D:
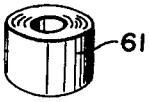

A typical distribution of the magnetic fluxes and the eddy currents developed in the heated element are shown in FIG. 4. In FIG. 4(*a*), for example, the magnetic flux formed by the central magnetic circuit is large, and the magnetic flux is passed in at the center of the heated element 1 and is passed out from the periphery thereof. The eddy current passes by forming a loop shown at J, because the eddy current has a phase difference of about 90° to the magnetic flux being excited. On the other hand, a phase difference of about 90° found between the magnetic fluxes formed by the central excitation circuit and the peripheral excitation circuit crosses the zero point when the magnetic flux formed by the central excitation circuit is at a maximum, and accordingly, the change of the magnetic flux formed by the peripheral excitation circuit is a maximum, whereby the eddy current J is formed. According to Fleming's right-hand rule, the electromagnetic force is parallel to the surface of the heated element as considered in the drawing, and it is clear that there is no radical component nor circumferential component of the electromagnetic force.

FIG. 4(*b*) shows typical distributions of the magnetic flux and the eddy current at the time passing ¼ period, or 90° current phase from that of FIG. 4(*a*). According to the Fleming's right-hand rule, again it is clear that the turning effect, that is the circumferential component of the electromagnetic force, is not given to the heated element. It is easily presumed that no turning effect is given to the heated element at other times.

When the center of the heated element 1 is not aligned with the center of the exciter, it is considered to form a radical component of the electromagnetic force. It is possible then to give a force for returning the heated element to the center of the exciter by selecting a suitable relationship of the phases of the two excitation currents. This is a quite advantageous phenomenon in practice.

In an induction heating type cooking apparatus using commercial frequency, as shown in FIG. 1, it has been clearly stated in the disclosure of U.S. patent application Ser. No. 372,610, now U.S. Pat. No. 3,906,181, that an element 1 to be heated and having the inner bottom layer thereof made of ferromagnetic material, such as iron plate, and the outer bottom layer thereof made of nonmagnetic highly conductive material, such as aluminum or copper, gives high efficiency where the cover plate 2 is preferably a stainless steel plate, a ceramic plate or a heat resistance resin laminated plate. The characteristic feature and advantages of the structure of the exciter of the present invention for such use have already been illustrated. Accordingly, typical embodiments of the iron cores used in the exciter will now be illustrated.

An iron core of the exciter of this invention is shown in FIG. 5 wherein schematic views of the total structure are shown in FIG. 5(*a*), a part of the yoke is shown in FIG. 5(*b*), the central magnetic pole in FIG. 5(*c*), and the peripheral magnetic poles in FIG. 5(*d*). The various parts are formed by winding ferrosilicon plate. The yoke 5 is formed by the combination of four pieces of the wound iron core 5*a* having sector shapes as shown in FIG. 5(*b*).

Figure 6A:
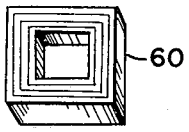
FIGS. 6(*a*), (*b*) and (*c*) are schematic views of other embodiments of the central magnetic poles.
Figure 6B:
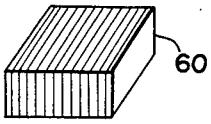
Figure 6C:
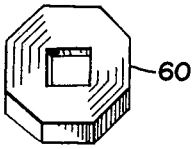

The magnetic pole 60 of circular wound iron core, shown in FIG. 5(*c*), is disposed at the center of the yoke 5, and the elliptical wound iron core magnetic poles 61 – 64, shown in FIG. 5(*d*), are disposed at four equi-angularly spaced peripheral parts, whereby the total structure of the iron core shown in FIG. 5(*a*) is formed. In accordance with the structure of the iron core, the magnetic resistance can be low, and the iron loss is low as the eddy current is difficult to pass as the direction of the magnetic flux is parallel to the direction of the surface of the iron plate plied layers. It is not always necessary for the central magnetic pole 60 to be of circular configuration, as it also may be a rectangular wound iron core, such as shown in FIG. 6(*a*), a plied iron core, such as shown in FIG. 6(*b*), a pentagonal wound iron core, as shown in FIG. 6(*c*), and so on. The shape of the iron core can thus be selected depending upon the characteristics of the exciter which are most desirable.

Figure 7A:
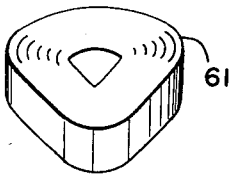
FIGS. 7(*a*), (*b*) and (*c*) are schematic views of other embodiments of the peripheral magnetic poles.
Figure 7B:
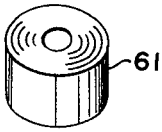
Figure 7C:
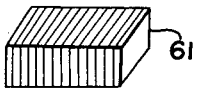

The shape of the peripheral magnetic poles 61 – 64 also do not necessarily have to be elliptical but they can be a sector wound iron core as shown in FIG. 7(*a*), a circular wound iron core as shown in FIG. 7(*b*), a plied iron core shown in FIG. 7(*c*) and the like.

Figure 8A:
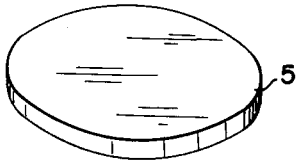
FIGS. 8(*a*), (*b*) and (*c*) are schematic views of other embodiments of the yoke of the exciter according to the invention.
Figure 8B:
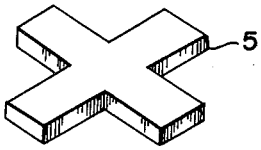
Figure 8C:
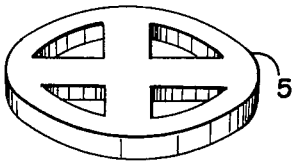

In the exciter of the present invention, as stated above, the iron core is formed by using a wound iron core or a plied iron core of ferrosilicon plate. However, it is possible to impart the same effect by using a high resistant magnetic material, such as ferrite, as the parts. In FIG. 8, for example, embodiments of the yoke made of ferrite are shown, wherein FIG. 8(*a*) is a circular plate, FIG. 8(*b*) is a cross plate and FIG. 8(*c*) is a special shape in which useless parts from a magnetic standpoint are cut out from a circular plate.

Figure 9:
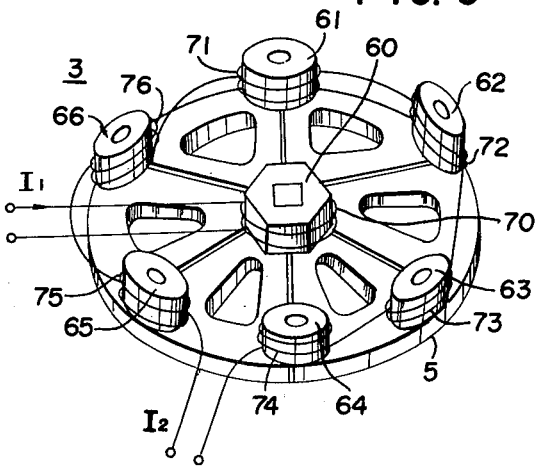
FIG. 9 is a schematic view of another embodiment of the exciter of this invention.

In the embodiments illustrated herein, four peripheral magnetic poles are shown. However, similar results can be expected by increasing or decreasing the number of the peripheral magnetic poles to 6 poles, 8 poles or even 2 poles, when the windings wound on the peripheral magnetic poles are desirably connected to form one excitation circuit. FIG. 9, for example, shows one embodiment having six peripheral magnetic poles disposed in a circular pattern about a central magnetic pole 60. A winding 70 is wound on the central magnetic pole 60 of a yoke 5, and windings 71 – 76 are wound on the peripheral magnetic poles 61 – 66 thereof.

The winding 70 wound on the central magnetic pole is used as the first excitation circuit and the windings 71 – 76 wound on the six peripheral magnetic poles are desirably connected as the second excitation circuit. AC current is fed so as to give the two excitation currents a phase difference of about 90°, to excite them, whereby a heated element can be heated without vertical vibration or turning movement being caused.

In accordance with experiments conducted with such embodiments of the invention, it has been confirmed that vibration of a heated element is less than 1 G and effective operation can be performed in a range of phase difference of between 70° and 110° for the two excitation currents.

As stated above, in accordance with the exciter of the invention, a turning effect for moving the heated element is not given by the exciter, whereby the heated element is kept in maximum efficiency and minimum vibrating condition, which are remarkably advantageous.

Obviously, many modifications and variations of the present invention are possible in light of these teachings. It is therefore to be understood that within the scope of the appended claims, the invention can be practiced otherwise than as specifically described herein.

What is claimed as new and desired to be secured by Letters Patent of the United States is:

1. Induction heating apparatus comprising:

a central magnetic pole, a plurality of peripheral magnetic poles positioned equidistant from the central magnetic pole, a yoke for positionally disposing the central magnetic pole and the peripheral magnetic poles, a cover plate supported by the peripheral magnetic poles, a heated element supported by the cover plate, a central excitation winding wound about the central magnetic poles, a plurality of peripheral excitation windings wound about the peripheral magnetic poles, a first excitation circuit comprising the central excitation winding, means connecting the peripheral excitation windings to form a second excitation circuit.

means for energizing the first excitation circuit with a first excitation circuit and for energizing the second excitation circuit with a second excitation current having a difference in phase with respect to the first excitation current of 70°–110° to generate an electromagnetic force perpendicular to the cover plate so that no turning force is applied to the heated element and so that vertical vibration is prevented while at the same time generating eddy currents in the heated element from alternating magnetic fluxes to heat the heated element.

2. An induction heating apparatus according to claim 1 wherein the yoke comprises a plurality of wound iron cores.

3. An induction heating apparatus according to claim 1 wherein the central and peripheral magnetic poles comprise wound iron cores.

4. An induction heating apparatus according to claim 1 wherein the central and peripheral magnetic poles comprise ferrite material.

5. An induction heating apparatus according to claim 1 wherein the peripheral magnetic poles comprise a wound iron core having a sector configuration.

6. An induction heating apparatus according to claim 1 wherein the central magnetic pole and the peripheral magnetic poles support the cover plate.

7. An induction heating apparatus according to claim 1 wherein the phase difference is 90°.

* * * * *